US009511418B2

(12) United States Patent
Duelm

(10) Patent No.: US 9,511,418 B2
(45) Date of Patent: Dec. 6, 2016

(54) METHOD OF CASTING PARTS USING HEAT RESERVOIR, GATING USED BY SUCH METHOD, AND CASTING MADE THEREBY

(71) Applicant: UNITED TECHNOLOGIES CORPORATION, Farmington, CT (US)

(72) Inventor: Bradley T. Duelm, Wethersfield, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 578 days.

(21) Appl. No.: 13/929,289

(22) Filed: Jun. 27, 2013

(65) Prior Publication Data

US 2014/0090383 A1 Apr. 3, 2014

Related U.S. Application Data

(60) Provisional application No. 61/708,565, filed on Oct. 1, 2012.

(51) Int. Cl.

| | |
|---|---|
| ***B22C 9/04*** | (2006.01) |
| ***B22D 25/00*** | (2006.01) |
| ***B22D 30/00*** | (2006.01) |
| ***F23R 3/00*** | (2006.01) |
| ***B22C 9/22*** | (2006.01) |

(52) U.S. Cl.

CPC ..... *B22D 30/00* (2013.01); *B22C 9/04* (2013.01); *B22C 9/22* (2013.01); *B22D 25/00* (2013.01); *F23R 3/002* (2013.01); *F23R 3/007* (2013.01); *F23R 2900/00018* (2013.01)

(58) Field of Classification Search

CPC ..... B22D 15/00; B22D 25/00; B22D 30/00; B22C 9/04

USPC ..... 164/122, 125, 127, 23, 516, 44, 45, 249,164/271, 371

See application file for complete search history.

(56) References Cited

U.S. PATENT DOCUMENTS

| | | | |
|---|---|---|---|
| 3,233,294 | A | 2/1966 | Carpousis et al. |
| 3,434,527 | A | 3/1969 | Bedell |
| 3,465,812 | A | 9/1969 | Dieters et al. |
| 5,234,046 | A | 8/1993 | Kuhn et al. |
| 2002/0084057 | A1 | 7/2002 | Naik et al. |

(Continued)

FOREIGN PATENT DOCUMENTS

| | | |
|---|---|---|
| EP | 2092999 A1 | 8/2009 |
| GB | 2194000 A | 2/1988 |

OTHER PUBLICATIONS

International Search Report and Written Opinion for related International Application No. PCT/US2013/51301 report dated Apr. 22, 2014.

(Continued)

*Primary Examiner* — Kevin P Kerns
(74) *Attorney, Agent, or Firm* — Cantor Colburn LLP

(57) ABSTRACT

A casting, mold and method for producing a casting are disclosed. The casting may have an area of small thermal mass and an area of large thermal mass. The method includes providing a casting having a work product and an appendage engaged to, and suspended over, the work product between the area of small thermal mass and the area of large thermal mass, and controllably cooling the work product using the appendage.

7 Claims, 5 Drawing Sheets

(56) References Cited

U.S. PATENT DOCUMENTS

| | | | | |
|---|---|---|---|---|
| 2005/0247429 | A1* | 11/2005 | Turkington | B22C 9/04 164/516 |
| 2007/0044933 | A1* | 3/2007 | Santeler | B22C 7/02 164/44 |
| 2010/0304161 | A1* | 12/2010 | Huang | B22D 27/045 428/469 |
| 2012/0175075 | A1* | 7/2012 | Sauerhoefer | B22C 9/043 164/23 |
| 2013/0025816 | A1* | 1/2013 | Bochiechio | B22D 17/00 164/312 |

OTHER PUBLICATIONS

Search Report regarding related EP App. No. 13 84 4465; dated May 24, 2016; 9 pgs.

* cited by examiner

METHOD OF CASTING PARTS USING HEAT RESERVOIR, GATING USED BY SUCH METHOD, AND CASTING MADE THEREBY

CROSS REFERENCE TO RELATED APPLICATIONS

This application is a non-provisional application claiming the 35 USC §119(e) benefit of U.S. Provisional Patent Application No. 61/708,565 filed on Oct. 1, 2012.

TECHNICAL FIELD

The present disclosure generally relates to relates to casting of parts and, more particularly, relates to a method, mold and casting with improved heat transfer through the use of sacrificial material.

BACKGROUND

Cast parts have many industrial applications. For example, many aerospace components such as those used in gas turbine engines are formed using a mold, which is filled with molten metal. The mold is formed in the desired shape of the part, such that when the molten metal cools and hardens, and the mold is removed, the part of desired shape is formed. Typically, casting is used as the predominant method of forming parts when the desired shape is complex or particularly difficult to form by other methods.

While effective, often cast parts have areas of small thermal mass (such as relatively thin sections) and areas of large thermal mass (such as relatively thick sections). As a result, such cast parts may experience tearing during the cooling process because of the large temperature differentials that may be present between the areas of small and large thermal mass. This necessarily results in scrapping of the casting, lost productivity and lost profitability. A better process is therefore needed.

SUMMARY OF THE DISCLOSURE

In accordance with one aspect of the disclosure, a method of casting a work product is disclosed. The method comprises producing a casting having a work product and a sacrificial appendage extending from, and suspended over, the work product, and controllably cooling the work product using the sacrificial appendage.

In another refinement, the method further includes removing the sacrificial appendage from the work product after the work product is cooled.

In another refinement, the work product includes an area of small thermal mass and an area of large thermal mass, and the method further includes positioning the sacrificial appendage between the area of small thermal mass and the area of large thermal mass.

In another refinement, the area of small thermal mass is a midspan of a combustor panel, and the area of large thermal mass is a stud of the combustor panel, and the method includes cantilevering the appendage over the midspan.

In another refinement, the method further comprises creating a mold that includes a cavity in the shape of the work product and a cavity in the shape of the sacrificial appendage, and pouring molten metal into the mold cavities.

In another refinement, the method further includes forming the mold from a ceramic.

In accordance with a further aspect of the disclosure, the method further includes forming a pattern in the shape of the casting, coating the pattern with an investment material, and removing the pattern from the investment material.

In a refinement, the method further includes forming the pattern of wax.

In accordance with another aspect of the disclosure, a mold is disclosed which may comprise a work product mold defining a small thermal mass cavity and a large thermal mass cavity, and a sacrificial material mold defining an appendage cavity, the appendage cavity being positioned over the work product cavity between the small thermal mass cavity and the large thermal mass cavity.

In a refinement, the sacrificial mold further includes a gating cavity.

In another refinement, the mold is ceramic.

In another refinement, the work product is a combustor panel for a gas turbine engine.

In a further refinement, the small thermal mass cavity forms a midspan of the combustor panel, and the large thermal mass cavity forms a stud of the combustor panel.

In accordance with another aspect of the disclosure, a casting having an area of large thermal mass and an area of small thermal mass, and the casting is formed by a method comprising forming a mold having a work product cavity and a sacrificial cavity, the sacrificial cavity extending over the work product cavity between the area of small thermal mass and the area of large thermal mass, filling the mold with molten metal, and controllably cooling the molten metal in the work product cavity using the molten metal in the sacrificial cavity.

In a refinement, the casting is a combustor panel of a gas turbine engine.

In a further refinement, the area of small thermal mass is a midspan of the combustor panel, and the area of large thermal mass is a stud of the combustor panel.

In a further refinement, the method of forming the casting further includes removing the sacrificial material from the work product once the molten metal is cooled.

In a refinement, the sacrificial material includes an appendage that cantilevers over the work product.

In a further refinement, the sacrificial material further includes gating, and the method further includes removing the gating from the work product.

In yet a further refinement, the method may further comprise sizing the sacrificial material cavity so as to equilibrate the thermal mass between the area of small thermal mass and the area of large thermal mass.

These and other aspects and features of the present disclosure will be better understood upon reading the following detailed description when taken in conjunction with the accompanying drawings.

DETAILED DESCRIPTION

Figure 1:
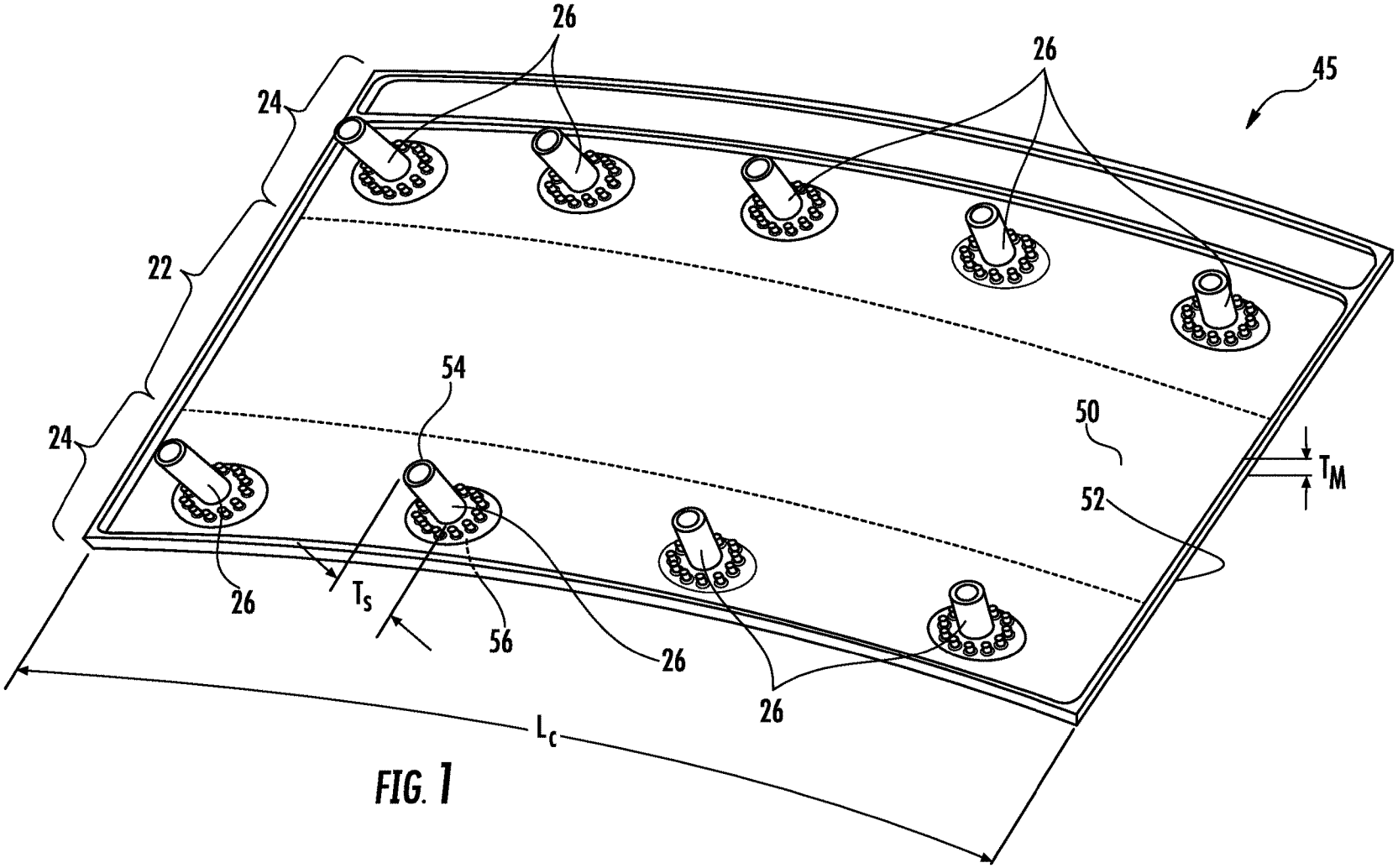
FIG. 1 is a perspective view of an exemplary work product produced according to the present disclosure.

Referring now to the drawings, and with specific reference to FIG. 1 an exemplary casting that may be made in accordance with the present disclosure is referred to as reference numeral 20. More specifically, the casting 20 depicted is a combustor panel for use in a gas turbine engine, but it is to be understood that the teachings of the present disclosure can be used with equal efficiency in forming many other intricate shapes, including, but not limited to, many other aerospace and gas turbine engine components.

As shown, the casting 20 may include a midspan 22 flanked by lateral sections 24. A plurality of studs 26 may extend from each lateral section 24. One of ordinary skill in the art will recognize the casting 20 as a combustor panel used in forming an annular liner for a gas turbine engine combustor when arranged in a circumferential fashion with other combustor panels. The studs 26 can then be used to attach an annular combustor shell (not shown) thereto in uniformly spaced fashion. Again, however, the teachings of the present disclosure can be used to form any number of other intricately designed parts, particularly aerospace parts.

Such parts may be made by an investment casting technique, where a pattern of the desired shape is formed of a dissolvable, meltable or otherwise destructible material such as wax. That wax pattern is then coated, sprayed or otherwise covered with an investment material such as ceramic. Once the investment material is hardened, the wax pattern can be melted to form a hollow mold in the shape of the desired part. Molten material is then poured into the mold to form the part.

While effective, with parts of certain shapes, the molten metal can cool at different rates in different locations in the part. For example, areas which are relatively thin or otherwise have small thermal mass may cool more quickly than thick areas, or which otherwise have large thermal mass, thus resulting in hot tears in the metal. When this happens, the part has to be scrapped, resulting in lost productivity and profits.

It is in this regard that the present disclosure greatly improves over the prior art. It does so by, among other things, employing sacrificial material in the mold to equilibrate the thermal mass across the part and thus controllably cool the part without hot tears.

Figure 2:
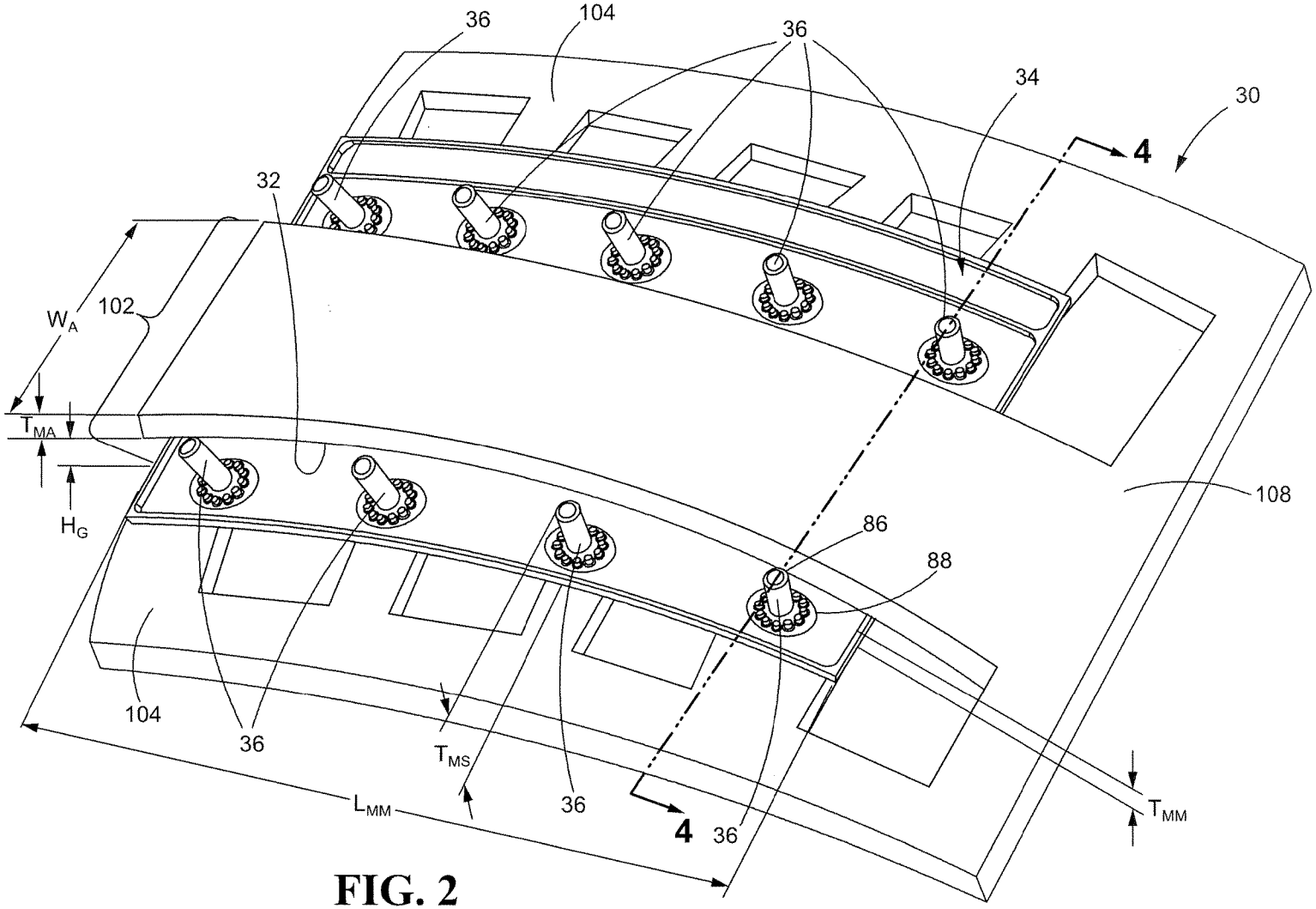
FIG. 2 is a perspective view of an exemplary mold used to make the work product of FIG. 1 in accordance with the disclosure.

Referring now to FIG. 2, a mold 30 from which the casting can be made is depicted. As shown therein, the mold includes a midspan cavity 32 for forming the midspan 22, flanked by lateral section cavities 34 for forming lateral sections 24. In addition, each lateral section 34 includes stud cavities 36 for forming the plurality of studs 26. However, it will also be noted that the mold 30 includes a number of other cavities forming sacrificial portions 40 used only to facilitate the molding process.

Figure 3:
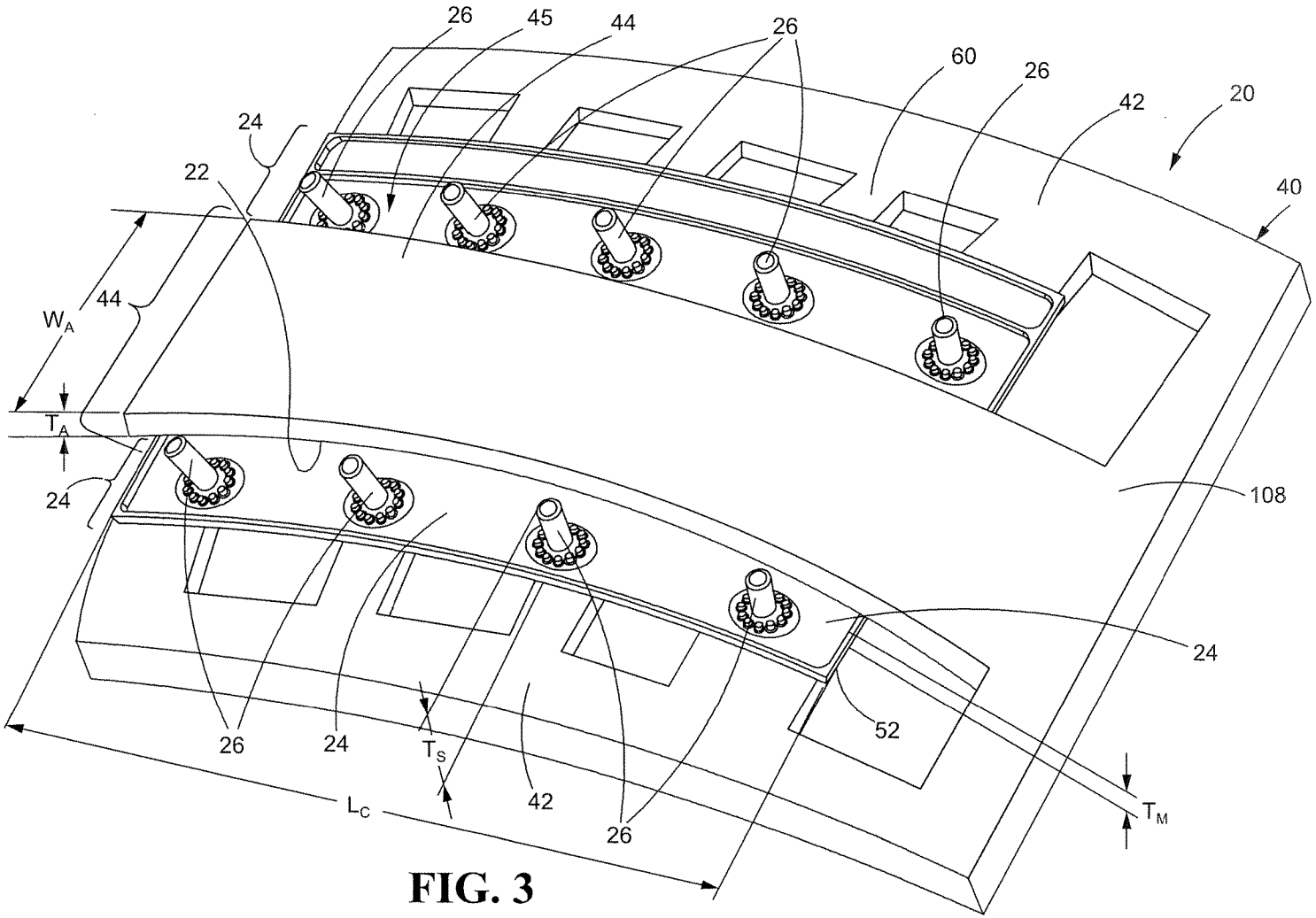
FIG. 3 is a perspective view of the exemplary casting used to make the work product of FIG. 1, but with sacrificial casted material still attached.

As shown best in FIG. 3, these sacrificial portions 40 include gating 42 and appendage 44. The gating 42 provides passages for communicating the molten metal to the midspan cavity 32, lateral section cavities 34, and stud cavities 36. Once the molten metal cools, the gating 42 is removed as by cutting, grinding, machining or the like.

Similarly, the appendage 44 is a sacrificial material 40 and does not ultimately form a usable portion of the finished work product 45. Rather, by cantilevering the appendage over the midspan cavity 32 in close proximity thereto, when the appendage 44 is poured and filled with molten metal along with the midspan cavity 32, lateral section cavities 34 and stud cavities 36, a more uniform thermal mass is created across the mold 30, thereby allowing for a more controllable and uniform temperature gradient across the mold 30 and casting 20. As the casting 20 is more uniformly cooled, the likelihood of hot tears in the metal is greatly abated relative to the prior art. Once cooled and hardened, the appendage 44 is removed along with the gating, to form the work product 20 of FIG. 1.

The relative dimensions of each section of the casting 20 are also of importance in equilibrating the thermal mass across the casting and tailoring the proper cooling rate of the molten metal. More specifically, in the exemplary casting 20, the midspan 22 is configured as a wall that extends the casting length $L_C$ as shown in FIG. 1. The midspan 22 has a thickness $T_M$, The $T_M$ may be measured from a front side 50 to a back side 52 of the midspan 22. In an embodiment, the thickness $T_M$ of the midspan 22 may be generally even across the midspan 22.

As best seen in the exemplary embodiment illustrated in FIG. 3, the wall-like midspan 22 is bordered on each side by the casting lateral sections 24. The plurality of studs 26 extend upwardly from each casting lateral section 24. Each stud 26 has a thickness $T_S$. In this embodiment, $T_S$ may be greater than the $T_M$. For the purposes of this disclosure, $T_S$ may be measured from a distal end 54 (distal to the lateral section 24) of the stud 26 to a proximal end 56 (adjacent the lateral section 24).

The dimensions and positions of the sacrificial material 40 relative to the work product 45 is also important. More specifically, as indicated above, the sacrificial material 40 may include gating 42 and appendage 44. The gating 42 may also include a lattice portion 60. In one embodiment, the lattice portion 60 may be adjacent to one or more sides of the casting 20. In the embodiment illustrated in FIG. 1, the lattice portion 60 is present on three sides of the casting 20. The gating 42 and appendage 44 are eventually removed from the initial casting of FIG. 3 to create the casting 20 seen in FIG. 1.

The appendage 44 may extend from, and cantilever over, the lattice portion 60. More specifically, the appendage 44 may extend over the midspan 22. In other embodiments, the appendage 44 may be separate from the lattice portion 60 but may be disposed to extend over the midspan 22. The appendage 44 is configured such that it does not substantially extend over the lateral sections 24. In one embodiment, the appendage 44 may extend over the midspan 22, but not over the lateral sections 24. The appendage 44 has a thickness $T_A$.

Figure 4:
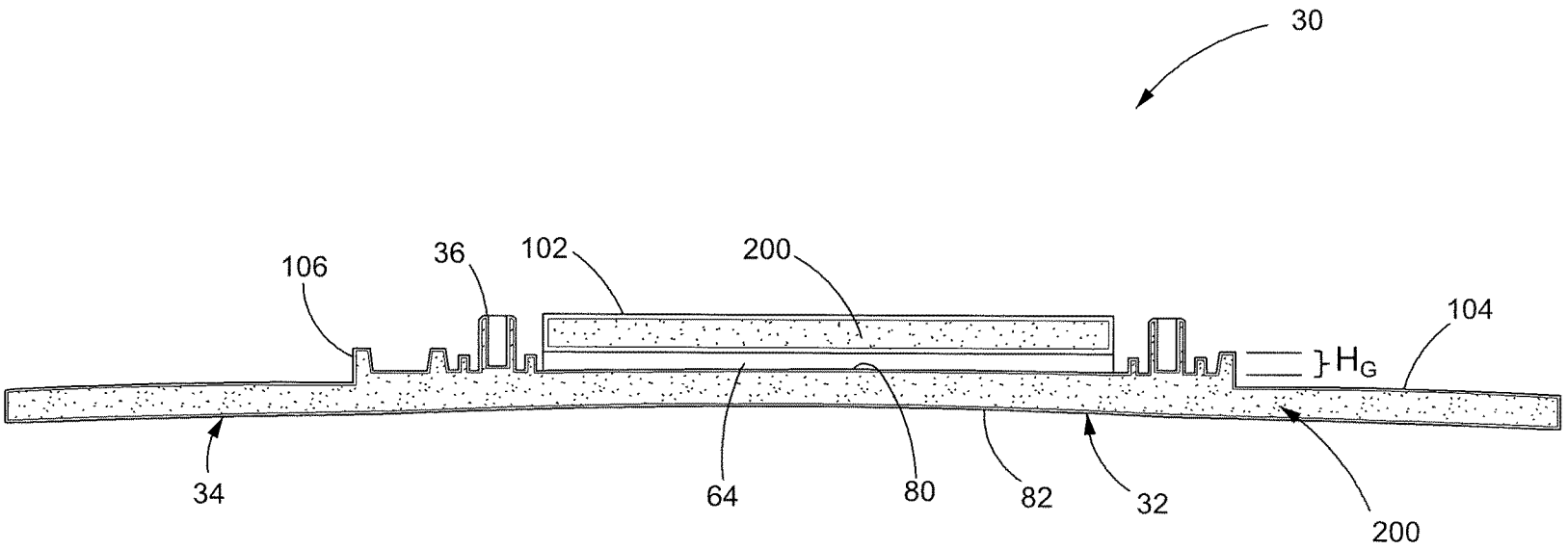
FIG. 4 is a sectional view of the mold of FIG. 2, taken along line 4-4 in FIG. 3.

The appendage 44 and the midspan 22 may define a gap 64 disposed therebetween as shown in FIG. 4. In one embodiment, the gap 64 may extend substantially along the length $L_C$ of the midspan 22 and along the width $W_A$ of the appendage 44. In one embodiment, the gap 64 height $H_G$ may be in the range of about 3 millimeters to about 56 millimeters. In another embodiment, $H_G$ may be in the range of about 13 millimeters to about 46 millimeters. Other ranges are also contemplated for the gap 64 height $H_G$, and the gap 64 height $H_G$ is not limited to the specific ranges disclosed above. In an embodiment, $T_S$ may be about the sum of $T_M$ and $T_A$ and $W_A$. In one embodiment, the casting 20 may be made of steel, aluminum or the like.

The dimensions and relative positions of the parts of the mold 30 generally mirror the shape, and relative dimensions of the desired casting. For example, as shown in FIG. 2, the mold 30 may have a midspan cavity 32 that extends the length $L_{MM}$ of the desired midspan 22. Moreover, the mold midspan cavity 32 has a thickness $T_{MM}$. The $T_{MM}$ may be measured from a front side 80 of the midspan cavity 32 to a back side 82 of the midspan cavity 32.

In this exemplary embodiment, the wall-like mold midspan cavity 32 is bordered on each side by lateral section cavities 34. A plurality of mold stud cavities 36 extend upward from each mold lateral section cavity 34. Each mold stud cavity 36 may have thickness $T_{MS}$. In this embodiment, $T_{MS}$ may be greater than the $T_{MM}$. Each of these stud cavities 36, in this exemplary embodiment, may be configured as a stud shape. For the purposes of this disclosure, $T_{MS}$ may be measured from a distal end 86 (distal to the mold lateral section 34) of the mold stud cavity 36 to a proximal end 88 of the mold stud cavity 36.

The mold 30 may also include cavities, an appendage cavity 102 and gating cavity 104. Similar to the discussion regarding the casting gating 42, the mold gating cavity 104 may also include a mold lattice cavity 106. In one embodiment, the mold lattice cavity 106 may be adjacent to one or more sides of the mold midspan cavity 32. In the embodiment illustrated in FIG. 2, the mold lattice cavity 106 is present on three sides of the mold midspan cavity 32.

In an embodiment, the mold appendage cavity 102 may extend from the mold lattice cavity 106 at joint 108. More specifically, the appendage cavity 102 may extend over the mold midspan cavity 32. In other embodiments, the mold appendage cavity 102 may be separate from the mold lattice cavity 106 but may be disposed to extend over the mold midspan cavity 32. In one embodiment, the mold appendage cavity 102 may extend substantially the length $L_{MM}$ of the mold midspan cavity 32. The mold appendage cavity 102 may be configured such that it does not substantially extend over the mold lateral cavities 34. In one embodiment, the mold appendage cavity 102 may extend over the mold midspan cavity 32 but not over the mold lateral cavities 34. The mold appendage cavity 102 has a thickness $T_{MA}$. In an embodiment, $T_{MA}$ may be about the sum of $T_A$ and $T_M$. In one embodiment, the mold 30 may be made of ceramic or the like.

FIG. 4 illustrates a cross-section of the mold 30 of FIG. 2 before a pattern 200 is removed (in the wax embodiment mentioned above, melted out of) from the mold 30. The method may further include removing the pattern 200 from the mold 30 and in doing so leaving the mold cavities 32, 34 and 36. In one embodiment, the pattern 200 may be made of wax, or the like. The mold 30 and enclosed pattern 200 may be heated to melt the wax. The melted wax may then be drained out of the mold 30. Once the pattern 200 is removed from the mold 30, the mold 30 defines the cavities 32, 34 and 36 and is ready for receipt of molten metal therein.

Figure 5:
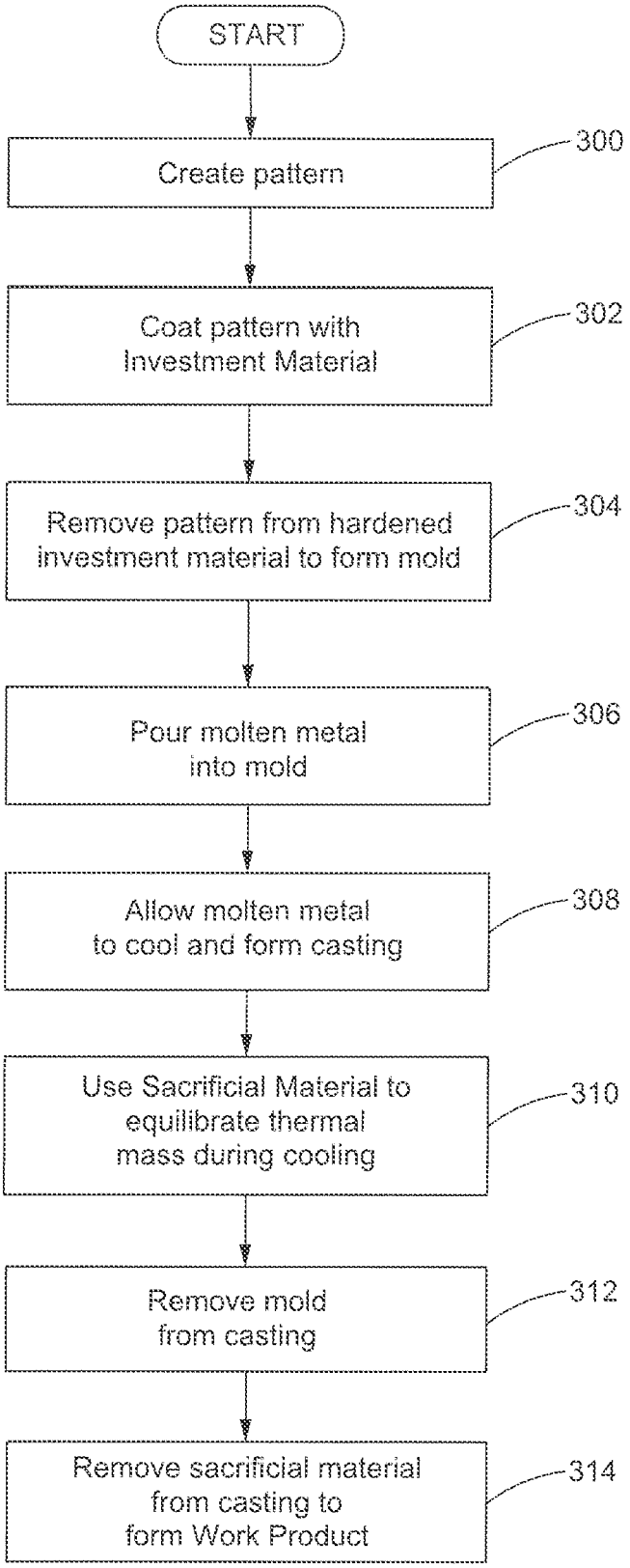
FIG. 5 is a flow chart depicting a sample sequence of steps which may be practiced according to the present disclosure.

In operation, the present disclosure sets forth a method for producing the casting 20. This is best depicted in flow chart format in FIG. 5. The method may begin by creating a pattern 200 as indicated in step 300. As indicated above, this may be by using wax or some other easily destructible material. That pattern 200 can then be covered by an investment material as shown in step 302. The wax can then be melted and removed from the hardened investment material to form the hollow mold 30 as shown in step 304.

The method may further include prime coating the wax pattern in a fine refractory material, with that fine refractory material then being coated with the investment material to create the mold 30. The mold 30 may then be allowed to harden. The investment material may be ceramic particles, or another appropriate material known in the art for use in creating an investment mold.

Once created, the mold 30 includes the midspan cavity 32, flanking section cavities 34, and stud cavities 36, as well as the gating cavity 104 and appendage cavity 102. After the wax pattern is melted and removed, the method may further include pouring molten metal into the mold 30 as shown in step 306. The molten metal is then allowed to cool in the mold 30 to form the casting 20 as shown in step 308.

During cooling of the molten metal/casting 20, large temperature differences between the casting sections, particularly between the midspan 22 and studs 26 are avoided. This is as a direct result of providing the appendage 44 over the midspan 22 in close proximity to both the midspan 22 and the studs 26. In the absence of the appendage 44 being provided adjacent to the midspan 22, large temperature differences therebetween may promote tearing between the areas of relatively small thermal mass, such as the midspan 22, and areas of relatively large thermal mass, such as the studs 26, during cooling of the casting 20. As stated above, such tearing often results in the casting 20 being scrapped. However, the placement of the appendage 44 substantially over the midspan 22, the thickness $T_A$ of the appendage 44, and the close proximity of the appendage 44 to the midspan 22 slows the cooling of the midspan 22 such that the midspan 22 and the appendage 44 cool at approximately the same rate as the studs 26, thus minimizing the tearing of the casting 20. Stated differently, the large thermal mass of the appendage 44 reduces the temperature differential between the midspan 22 and studs 26, and in doing so reduces the likelihood of hot tearing. This is represented in the flow chart as step 310.

Referring again to FIG. 5, the method may further include removing the mold 30 from the cooled metal casting 20 as shown by step 312. In one embodiment, the mold 30 may be removed from the casting 20 by chipping off the mold 30 from the cooled casting 20. In other embodiments, the mold 30 may be removed by hammering, media blasting, vibrating, water jetting, chemically dissolving, or the like.

As discussed earlier, casting 20, once removed from the mold 30, includes the sacrificial material 40 attached thereto in the form of the gating 42 and the appendage 44. The method of the present disclosure may further include removing the sacrificial material 40 from the casting 20 as shown by a step 314. Removal of the gating 42 and appendage 44 from the casting 20 may be done by sawing, laser cutting, hammering, or the like, and results in a casting 20 such as that in FIG. 1. In other embodiments, the mold 30 and sacrificial material 40 may be removed at approximately the same time by sawing, laser cutting, hammering, or the like.

INDUSTRIAL APPLICABILITY

From the foregoing, it can be seen that the present disclosure sets forth a casting method, mold and casting with many industrial applications. For example, in the manufacture of gas turbine engines, parts of very intricate shapes are needed. As those shapes employ portions of varying thicknesses and sizes, when the metal forming the casting cools, the present disclosure sets forth specifically shaped and positioned sacrificial materials to enable the entire casting to cool more uniformly and in a controlled manner. In so doing, tears in the molten metal are avoided, usable castings are created, and scrapped castings are minimized.

While the foregoing has been given with reference to combustor panels for gas turbine engines, it is to be understood that the teachings herein can be employed in forming many other gas turbine engine components, other aerospace components, and any other casting of complex shape regardless of its ultimate industrial application.

What is claimed is:

1. A method of casting a work product, comprising:

forming a pattern in the shape of a casting;

coating the pattern with an investment material;

removing the pattern from the investment material to form a mold that includes a cavity in the shape of the work product and a cavity in the shape of a sacrificial appendage;

pouring molten metal into the mold cavities;

producing the casting having the work product and the sacrificial appendage extending from, and suspended over, the work product in an arcuate orientation and cantilevered therefrom, the work product comprising an area of small thermal mass and an area of large thermal mass, the area of small thermal mass is a midspan of a combustor panel, the area of large thermal mass is a stud of the combustor panel;

positioning the sacrificial appendage between the area of small thermal mass and the area of large thermal mass, the sacrificial appendage cantilevered over the midspan; and controllably cooling the work product using the sacrificial appendage.

2. The method of claim 1, wherein the method further includes removing the sacrificial appendage from the work product after the work product is cooled.

3. The method of claim 1, further including forming the mold from a ceramic by coating the pattern with the investment material comprising a ceramic material.

4. The method of claim 1, further including forming the pattern of wax.

5. The method of claim 1, wherein the casting is a combustor panel of a gas turbine engine.

6. The method of claim 1, wherein the method of forming the casting further includes removing the sacrificial material from the work product once the molten metal has cooled.

7. The method of claim 1, wherein the sacrificial material further includes gating, and the method further includes removing the gating from the work product.

* * * * *